United States Patent [19]

Patterson

[11] Patent Number: 4,768,785

[45] Date of Patent: Sep. 6, 1988

[54] TRAINING DEVICE FOR BASEBALL/BATTING PRACTICE SOFTBALL

[76] Inventor: George Patterson, 15 Hollyrood Ave., Lowell, Mass. 01851

[21] Appl. No.: 1,035

[22] Filed: Jan. 7, 1987

[51] Int. Cl.[4] ..... A63B 59/00

[52] U.S. Cl. ..... 273/26 B; 273/72 R

[58] Field of Search ..... 273/26 B, 67 DA, 67 R, 273/65 GE

[56] References Cited

U.S. PATENT DOCUMENTS 3,955,816 5/1976 Bratt ..... 273/26 B 4,555,111 11/1985 Alverez ..... 273/26 B

*Primary Examiner*—Richard C. Pinkham

*Assistant Examiner*—T. Brown

*Attorney, Agent, or Firm*—Pearson & Pearson

[57] ABSTRACT

A practice device for assisting a batter in learning a proper swing includes an elongated, lightweight, tubular member having two longitudinal ends which forms a longitudinal extension of the handle of the bat. The extension is circularly symmetrical about the longitudinal axis of the bat and has a fastener at one end for attachment coaxially of the member to the bat handle.

6 Claims, 1 Drawing Sheet

Fig.1.
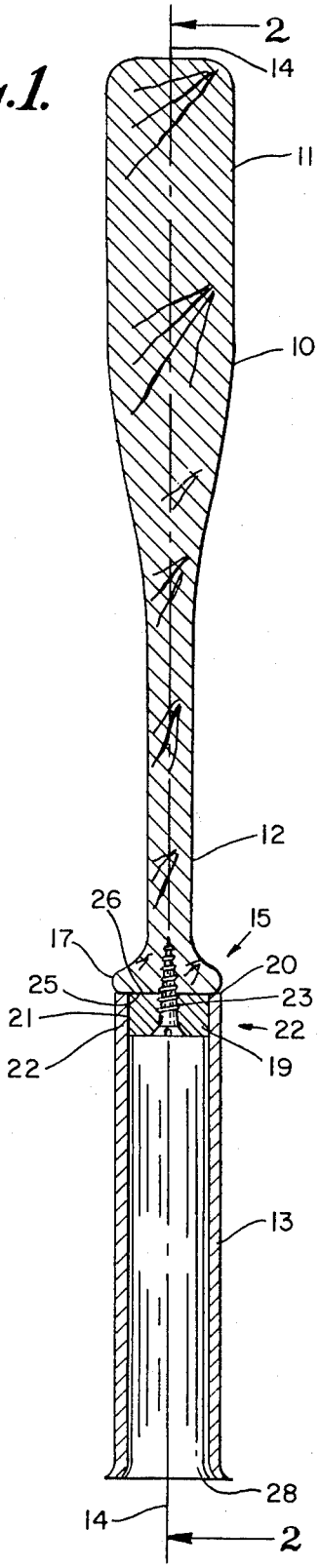
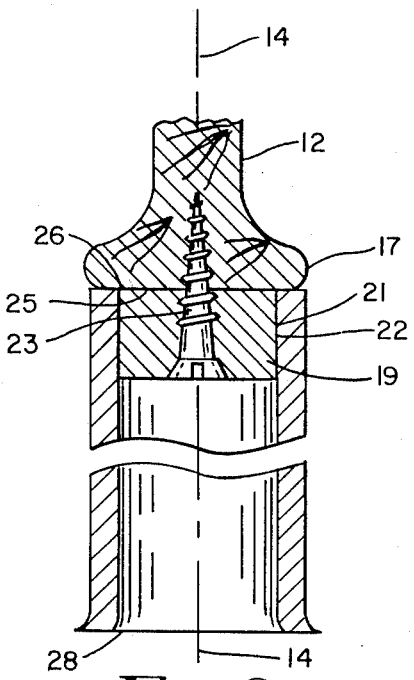
Fig.2.
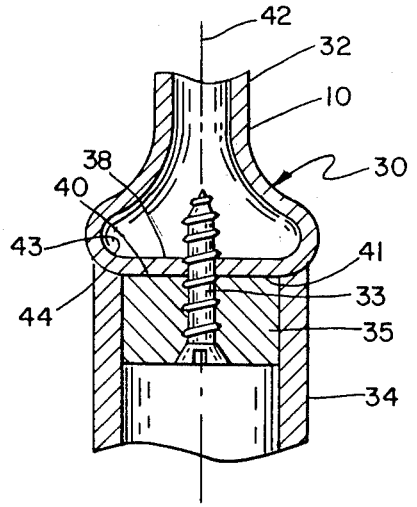
Fig.3.

TRAINING DEVICE FOR BASEBALL/BATTING PRACTICE SOFTBALL

FIELD OF THE INVENTION

The invention relates to practice devices, and more particularly to practice devices especially for use in learning a proper swing for a baseball/softball bat.

BACKGROUND OF THE INVENTION

Practice devices for various sports are known. For example, U.S. Pat. No. 2,471,610 to Christensen for "Rotatable Practice Ball Bat", May 31, 1949, describes a practice device for a batter which permits free rotation of the bat as the ball is struck, thus informing the batter when the ball is not struck squarely. U.S. Pat. No. 3,351,346 to Strahan for "Golf Swing Training Device", Nov. 7, 1967 proposes a golf practice device involving a shaft attachment of an extension to the golf club handle having a straight and bent portion, the latter having weights attached. The device is intended for use to inculcate a proper swing. U.S. Pat. No. 3,880,423 to Kreag for "Baseball Bat Having Different Striking Surfaces", Apr. 9, 1975, proposesa novel bat, not rotationally symmetrical about an axis as is a conventional bat, for a ball game different from the conventional ball game, and employing targets to be hit by the ball after it is batted by the bat. U.S. Pat. No. 3,955,816 to Bratt for "Warm-up Bat", May 11, 1976, describes a sleeve for attachment to the batting portion of the bat for adding weight to the bat for the batter's warm-up.

U.S. Pat. No. 4,214,751 to Simpson for "Adjustable Bunting Bat With Protective Shield", July 29, 1980, describes an insertable bat handle section for shortening a baseball bat, and a shield for protecting the hand of the batter, when the section is inserted, so that he may practice one-handed bunting with the shortened bat, thereby learning the proper way of holding the bat for a bunt.

My U.S. Pat. No. 4,595,204 for "Device For Practicing Golf Club Swing", June 17, 1986 describes a device for practicing a golf swing. This device is an elongated extension removably attached to the handle of the club to extend normally upwardly under the left arm pit to a level about the level of, and behind the shoulders. This device aids in perfecting a proper golf driving swing.

SUMMARY OF THE INVENTION

According to the invention, an elongated, lightweight tubular member is attached to the bat handle to form a longitudinal extension of the handle of a bat. The extension length is such that the extension end remote from the handle, brushes the batter's mid-section when the bat is held in ball-striking position in front of the batter. The extension has at one end, means for attachment coaxially to the bat handle including an axially positioned screw to attach the extension member to the handle end. The diameter of the extension near the handle is preferably not greater than the maximum diameter of the handle of the bat so that the extension does not interfere with the batter's hand-hold.

DESCRIPTION OF THE DRAWINGS

The various objects, advantages, and novel features of the invention will be more fully understood from the following detailed description when read in connection with the accompanying drawing, in which like reference characters refer to like parts, and in which:

FIG. 1 is a longitudinal view of a baseball/softball bat and the attached practice device embodying the invention;

FIG. 2 is an enlarged partial longitudinal sectional view of the handle portion of the bat and the practice device attached; and FIG. 3 is an enlarged partial longitudinal sectional view of another embodiment of the invention.

DETAILED DESCRIPTION

Referring to FIGS. 1 and 2, a baseball/softball bat 10 comprises a batting end 11, and a handle 12. A tubular extension 13 is attached at the other end 15, to the handle 12, and extends axially along the axis 14 from the handle a length between about twelve and twenty inches. The handle ends in a slightly enlarged diameter 17 to assist in maintaining the batter's grip.

The extension 13 is coaxial with the handle 12, and also rotationally symmetrical about the axis 14 and includes a plug or block 19 at one end 22, of the extension adjacent to the handle 12. The plug 19 at its outer diameter 20 is fastened to the inner diameter 21 of the extension 13 by any suitable means, as by a binding adhesive, or by countersunk set-screws (not shown) through the extension 13 penetrating the plug 19 and retaining the plug irrotationally to the extension 13.

Means, for example, such as a screw 23 inserted axially in the plug 19 and penetrating the bat 10, fastens or attaches the extension 13 to the handle 12. The bat 10 illustrated in FIGS. 1 and 2 is of wood, or aluminum. The extension may be of resin based material and the plug may also be of a resin based or other material. If the bat is of metal and hollow, such as an aluminum bat, the screw 23, instead of being a wood screw, should be a metal or so-called self-tapping screw which will engage the metal. However, a blunt ended or self-tapping screw can be used for either a wooden or aluminum bat.

The axially transverse end surface 25 of the bat handle 12, and the adjacent axially transverse end surface 26 of the extension 13, are complementary, both surfaces in this embodiment being flat. The fastening means of the screw 23, therefore, brings together and holds flush together in close contact the axially transverse and complementary adjacent surfaces 25, 26, so that the coaxial attachment of the bat 10 and the extension 13 is stable and secure. For a major portion of its length adjacent the bat handle 12, the outer diameter of the extension preferably is not greater than the enlarged outer diameter of the bat handle 17, so that there is no interference with the batter's grip upon the handle 12.

In making use of the training device, a batter grasps the bat 10, at the bat handle 12, with the extension 13 attached as shown. The batter then assumes the usual batting stance with the bat above the shoulder. Then he begins a swing, preferably slowly preliminarily. The extension 13 for a particular batter has a length to suit the batter's height and size. The end 28 of extension 13 from the other end surface 26, adjacent the handle 12 is intended to brush against the batter's mid-section or "tummy" if the swing is level and as the bat 10 is swung around through the position to engage the ball. If the swing is too high and not level to the ground then the end 28 of the extension passes in front of the lower portion of the mid-section. If the batter swings in the "correct" manner, turning his wrists "over" in order to perform a relatively flat swing, the end 28 engages a particular part of the batter's mid-section. If, however, the swing is too low and the batter drops the remote, distal end 11 of the bat so as to "loop" the bat, and fails to swing the bat in the desired correct manner, the end 28 of the extension 13 tends to brush the batter nearer the upper mid-section or chest area. The "correct" swing is relatively flat compared to the incorrect swing which "loops", and therefore, tends to hit "pop-ups" or high fly-balls. The correct or flatter swing tends to drive the ball more distantly in a flatter trajectory, and affords a better chance for a hit. Therefore, the position of the extension and its use and application are quite different from the extension for golf training of my prior patent. In the present instance, there is no extension fitting under the arm pit, nor does the extension loop under the hands with the swing, as is the case in my prior invention, nor is the extension bent, as in the above mentioned Strahan Patent.

FIG. 3 illustrates an alternative embodiment in which a bat 30 is of metal and hollow. To the bat handle 32 a screw 33 attaches an extension 34. The screw 33 passes through a block or plug 35 which may in turn be attached to the extension 34 as suggested for the block or plug 19 of FIGS. 1 and 2 to the bat 10. The screw 33 is a so-called self-tapping or metal screw to engage the metal end 38 of the bat 30.

The adjacent end surface 40 of the extension 34 is complementary to the adjacent end surface 41 of the bat 30 at the handle 32. To enhance the complementarity of the adjacent end surface of the tubular material of which the tubular part of extension 34 is formed may be chamfered or beveled 43, circularly symmetrically about the axis 42 of circular symmetry, as at 43, to complement the axially curved and circularly symmetrical surface 44 of the rounded end of the bat handle 32 leading to the flat portion of the end surface 41 of the handle 32. Thus, the adjacent axially transverse end surfaces are held flush against each other. The extension 34 is used with the bat 32 in the same manner as the use of extension 13 with bat 10, as explained above.

The invention thus provides an easy and effective training device for teaching a batter to swing in a preferred manner at an oncoming pitched ball or ball held on a batting tee.

I claim:

1. A practice device for assisting a batter in learning a proper swing with one of a baseball and a softball bat, the bat having two generally cylindrical ends and a longitudinal axis, one end having a smaller diameter about the axis than the other end, a handle at the smaller diameter end, comprising:

an elongated, lightweight tubular member forming a longitudinal extension of the smaller diameter handle end, the extension being circularly symmetrical about the axis and of a length to brush against the batter's mid-section when the bat is held by the handle in ball-striking position in front of the batter, the longitudinal tubular member having two longitudinal ends; and means at the handle end coaxially attaching the member to the bat handle.

2. A practice device as claimed in claim 1, the attachment means comprising an axially positioned screw means.

3. A practice device as claimed in claim 1, the extension having an outer diameter adjacent the handle no greater than the outermost diameter of the bat handle, whereby the batter may freely hold the handle without interference from the attached extension.

4. A practice device as claimed in claim 1:

the extension having an axial length between about twelve and twenty inches.

5. A practice device as claimed in claim 1, the extension including a plug attached to the inside of and at the attachment end of the extension, the attachment screw means comprising a screw coaxially passing through the plug into the handle of the bat holding the plug and bat handle end together, the extension and the bat handle having end surfaces transverse to the axis complementary to each other and held flush against each other by the screw.

6. A practice device as claimed in claim 5, the end surfaces being flat.

* * * * *